US009404652B2

(12) United States Patent
Starcke

(10) Patent No.: US 9,404,652 B2
(45) Date of Patent: Aug. 2, 2016

(54) MIXING OF RECYCLE GAS WITH FUEL GAS TO A BURNER

(71) Applicant: Haldor Topsøe A/S, Kgs. Lyngby (DK)

(72) Inventor: Claus Robert Starcke, Roskilde (DK)

(73) Assignee: Haldor Topsoe A/S, Lyngby (DK)

( * ) Notice: Subject to any disclaimer, the term of this patent is extended or adjusted under 35 U.S.C. 154(b) by 0 days.

(21) Appl. No.: 14/308,869

(22) Filed: Jun. 19, 2014

(65) Prior Publication Data

US 2015/0010871 A1 Jan. 8, 2015

(30) Foreign Application Priority Data

Jul. 2, 2013 (EP) ..... 13174685

(51) Int. Cl.

| | |
|---|---|
| ***F23D 14/22*** | (2006.01) |
| ***F23D 99/00*** | (2010.01) |
| ***F23C 9/00*** | (2006.01) |
| ***F23D 14/24*** | (2006.01) |

(52) U.S. Cl.

CPC . *F23D 14/22* (2013.01); *F23C 9/00* (2013.01); *F23D 14/24* (2013.01); *F23D 21/005* (2013.01); *F23D 91/02* (2015.07); *F23C 2202/20* (2013.01)

(58) Field of Classification Search

CPC ..... F23C 9/00; F23D 14/22; F23D 91/02
USPC ..... 431/9, 8, 115
See application file for complete search history.

(56) References Cited

U.S. PATENT DOCUMENTS

| | | | | |
|---|---|---|---|---|
| 4,076,612 | A * | 2/1978 | Hollaway | 208/414 |
| 4,995,807 | A * | 2/1991 | Rampley et al. | 431/9 |
| 5,411,394 | A * | 5/1995 | Beer et al. | 431/9 |
| 5,496,170 | A * | 3/1996 | Primdahl et al. | 431/187 |
| 6,695,609 | B1 | 2/2004 | Chung et al. | |
| 2002/0086257 | A1 | 7/2002 | Primdahl | |
| 2002/0197574 | A1 | 12/2002 | Jones et al. | |
| 2007/0010590 | A1 | 1/2007 | Abbott et al. | |
| 2007/0231761 | A1 * | 10/2007 | Rosen et al. | 431/350 |
| 2008/0035890 | A1 | 2/2008 | Martens | |
| 2008/0244975 | A1 * | 10/2008 | Johnston | 48/197 FM |

* cited by examiner

*Primary Examiner* — Steven B McAllister
*Assistant Examiner* — Rabeeul Zuberi
(74) *Attorney, Agent, or Firm* — Blank Rome LLP

(57) ABSTRACT

A burner with a central oxidizer supply tube and an outer concentric fuel supply tube has a recycle gas duct arranged between the central oxidizer supply tube and the outer concentric fuel supply tube.

14 Claims, 1 Drawing Sheet

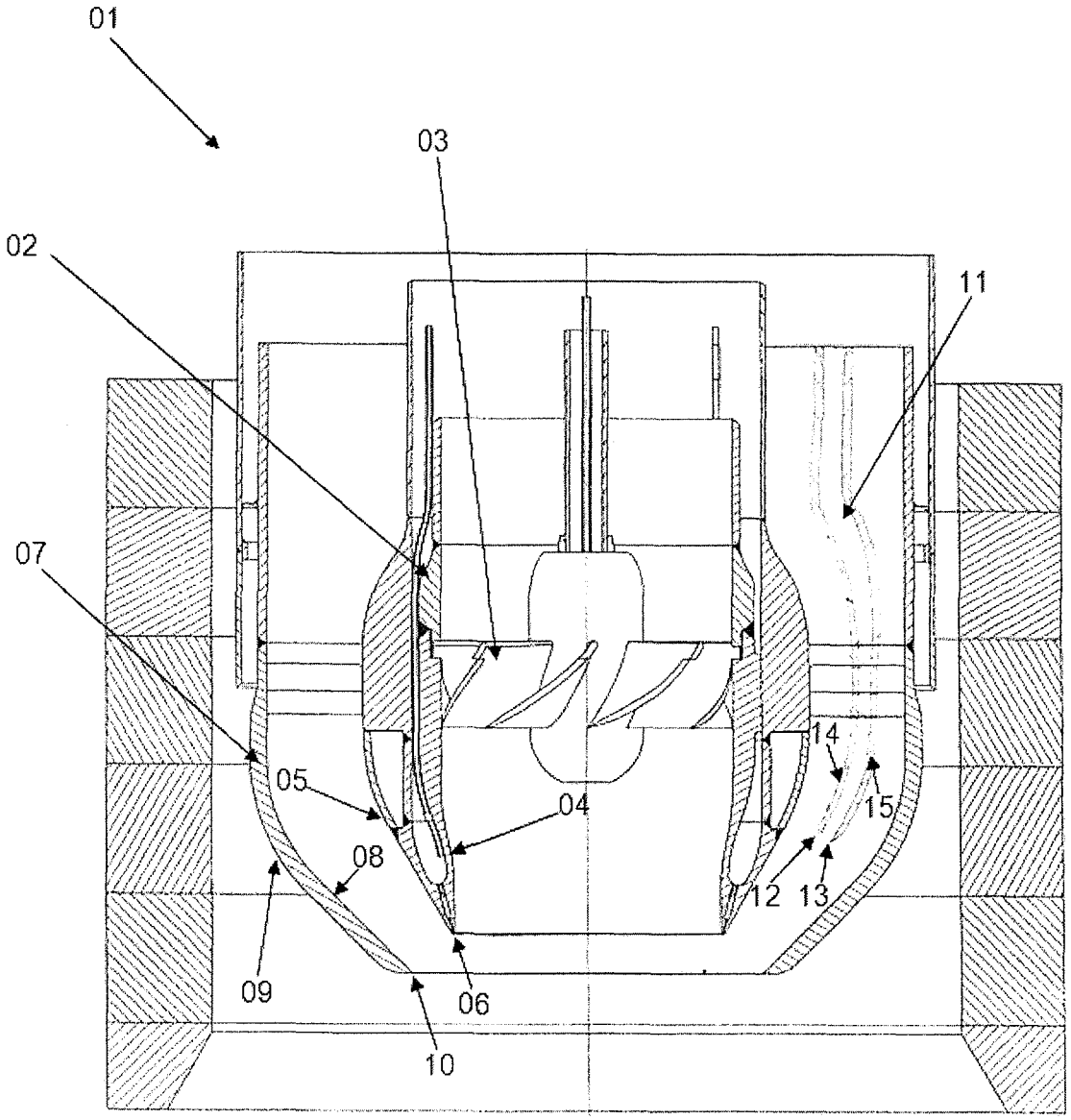
01
02
03
11
07
05
04
08
14
15
12
13
09
06
10

MIXING OF RECYCLE GAS WITH FUEL GAS TO A BURNER

BACKGROUND OF THE INVENTION

1. Field of the Invention

The present invention is directed to combustion of hydrocarbon fuel and in particular to a burner with a recycle gas duct for use in hydrocarbon fuelled combustion reactors.

2. Description of the Related Art

Burners of a combustion reactant are mainly used for firing gas-fuelled industrial furnaces and process heaters, which require a stable flame with high combustion intensities. Conventionally designed burners include a burner tube with a central tube for fuel supply surrounded by an oxidizer supply port. Intensive mixing of fuel and oxidizer in a combustion zone is achieved by passing the oxidizer through a swirler installed at the burner face on the central tube. The stream of oxidizer is, thereby, given a swirling-flow, which provides a high degree of internal and external recirculation of combustion products and a high combustion intensity.

Recycle gas from a Fisher Tropsh synthesis may cause severe metal dusting when mixed with hot feed gas to a syngas preparation unit, for example to the natural gas feed to an autohermal reformer. Therefore known art mixing arrangements are of complicated mechanical design, using expensive non reliable materials and coatings and/or installation of expensive recycle gas conversion reactor systems.

These problems are solved by the present invention which is a burner comprising means to mix a recycle gas just prior to and in the combustion zone of a catalytic reactor according to the claims, thus avoiding all metal dusting issues related to the above described mixing problems.

US Patent Application Publication No. 2008/0035890 discloses a process to prepare a synthesis gas comprising hydrogen and carbon monoxide comprises performing a partial oxidation on a methane comprising feed using a multi-orifice burner provided with an arrangement of separate passages, wherein the gaseous hydrocarbon having an elevated temperature flows through a passage of the burner, an oxidizer gas flows through a separate passage of the burner and wherein the passage for gaseous hydrocarbon feed and the passage for oxidizer gas are separated by a passage through which a secondary gas flows, wherein the secondary gas comprises hydrogen, carbon monoxide and/or a hydrocarbon.

A swirling burner for use in small and medium scale applications with substantially reduced internal recirculation of combustion products toward the burner face is disclosed in U.S. Pat. No. 5,496,170. The burner design disclosed in this patent results in a stable flame with high combustion intensity and without detrimental internal recirculation of hot combustion products by providing the burner with a swirling-flow of oxidizer having an overall flow direction concentrated along the axis of the combustion zone and at the same time directing the fuel gas flow towards the same axis. The disclosed swirling-flow burner comprises a burner tube and a central oxidizer supply tube concentric with and spaced from the burner tube, thereby defining an annular fuel gas channel between the tubes, the oxidizer supply tube and the fuel gas channel having separate inlet ends and separate outlet ends. U-shaped oxidizer and fuel gas injectors are arranged coaxial at the burner face. The burner is further equipped with a bluff body with static swirler blades extending inside the oxidizer injector. The swirler blades are mounted on the bluff body between their upstream end and their downstream end and extend to the surface of the oxidizer injection chamber.

US Patent Application Publication No. 2002/0086257 describes a swirling-flow burner with a burner tube comprising a central oxidizer supply tube and an outer concentric fuel supply tube, the oxidizer supply tube being provided with a concentric cylindrical guide body having static swirler blades and a central concentric cylindrical bore, the swirler blades extending from outer surface of the guide body to inner surface of oxidizer supply tube being concentrically arranged within space between the guide body and inner wall at lower portion of the oxidizer supply tube.

US Patent Application Publication No. 2007/0010590 describes a process for the production of hydrocarbons including; a) subjecting a mixture of a hydrocarbon feedstock and steam to catalytic steam reforming to form a partially reformed gas, b) subjecting the partially reformed gas to partial combustion with an oxygen-containing gas and bringing the resultant partially combusted gas towards equilibrium over a steam reforming catalyst to form a reformed gas mixture, c) cooling the reformed gas mixture to below the dew point of the steam therein to condense water and separating condensed water to give a de-watered synthesis gas, d) synthesising hydrocarbons from side de-watered synthesis gas by the Fischer-Tropsch reaction and e) separating the hydrocarbons from co-produced water, characterised in that at least part of said co-produced water is fed to a saturator wherein it is contacted with hydrocarbon feedstock to provide at least part of the mixture of hydrocarbon feedstock and steam subjected to steam reforming

SUMMARY OF THE INVENTION

Despite the state of the art as described in the above references, there is a need for a better solution to the problem of mixing an aggressive recycle gas in hydrocarbon fueled combustion reactors.

Accordingly, the present invention is a burner where a recycle process gas is flowing in between an inner and an outer tube of the burner, with a velocity that keeps the metal temperature below a critical metal dusting temperature. Existing recycle process gas lances have proven to be basically free of metal dusting due to low metal temperature and thus the recycle process gas nozzle of the present invention have the same advantage.

Outlet velocity of the recycle process gas nozzle should be the same as the fuel gas velocity at the position of the recycle gas nozzle tip. The position of the recycle gas nozzle tip is chosen in such a way that the oxidant and fuel gas part of the burner will only be in contact with pre-reformed gas (and/or oxidant) but not the recycle gas—and therefore have a low metal dusting potential. Mixing of the recycle process gas into the fuel is, however, high enough to ensure some mixing in order to eliminate the soot potential. As the recycle process gas will be released with fuel gas on both the inside and the outside, the mixing can be completed in the combustion chamber without soot formation.

The burner nozzles can therefore be made from a material with less metal dusting resistance and with less tendency to crack.

In a first aspect of the invention, a burner suited for a catalytic reactor comprises a central oxidizer supply tube for providing oxidant flow to a combustion zone of the reactor. A stationary swirler element is disposed inside the oxidizer supply tube to provide a swirling motion to the oxidant flow exiting the oxidizer supply tube. Concentric to the oxidizer supply tube, an outer fuel supply tube is arranged, thereby providing a doughnut shape channel for fuel flow supply to the combustion zone. The burner further comprises a process gas recycle duct which is arranged between the oxidizer supply tube and the fuel supply tube. The process gas recycle duct has an outlet nozzle which is located within the fuel supply area, in a distance X from the outer side of the oxidizer supply tube and a distance Y from the inner side of the fuel supply tube. This means that the burner parts will not be in direct contact with the recycle gas, as it will be surrounded by fuel gas. When leaving the recycle gas duct, the recycle gas will start to mix with the fuel gas.

In a specific embodiment, the recycle gas duct is an annular duct comprising two concentric recycle gas tubes. The distance between the outer side of the oxidizer supply tube and the inner recycle gas nozzle tip may be at least 1 mm. Likewise the distance between the inner side of the fuel supply tube and the outer recycle gas nozzle tip may be at least 1 mm. The distance of the lower part of the recycle gas duct and the oxidizer supply tube as well as the fuel supply tube is in one embodiment also at least 1 mm in order to ensure sufficient flow of fuel gas on both sides of the recycle gas duct.

To ensure partial mixing of the recycle process gas and the fuel before the two gasses exits the burner, the recycle gas nozzle tips may in one embodiment be arranged in a distance L up-stream with relation to the fuel flow direction from the oxidant nozzle tip and the fuel nozzle tip. In a further embodiment of the invention, this distance L is calculated with relation to the distance, Z between the two recycle gas tubes and the distance from the recycle gas tubes and the facing oxidizer supply tube and fuel supply tube, X and Y, the relation being: L is larger than zero and less than (X plus Y plus Z) multiplied by 20. Hence, if X and Y is 20 mm and L is 6 mm, the distance L would be between zero and $(20+20+6)\times 20=920$ mm.

In a further embodiment of the invention, the distance L is large enough to achieve more than 90% mixture of the recycle gas with the fuel before the fuel and the recycle gas passes the fuel nozzle tip. In this embodiment L can be determined by flow simulations and/or iterative tests.

In any of the embodiments, the fuel may be a gaseous hydrocarbon and the recycle process gas may be a recycle gas from a Fisher Tropsh synthesis.

BRIEF DESCRIPTION OF THE DRAWINGS

FIG. 1 shows a cross sectional view of a burner according to an embodiment of the invention.

DETAILED DESCRIPTION OF THE PREFERRED EMBODIMENT

FIG. 1 shows a cross sectional view of a burner 01 according to an embodiment of the invention. Coaxial with the center of the burner is a central oxidizer supply tube 02, comprising an inner wall 04, an outer wall 05 and an oxidant nozzle tip 06. To create a swirling motion of the oxidant flowing out of the oxidizer supply tube, a stationary swirler element 03 is arranged inside the oxidizer supply tube. Fuel is supplied to the combustion area via an outer concentric fuel supply tube 07, which has a fuel nozzle tip 10 arranged slightly lower than the oxidant nozzle tip. The inner wall of the fuel supply tube 08 faces the central oxidizer supply tube and the outer wall of the fuel supply tube 09 faces the reactor.

In order to provide recycle process gas to the reactor with low risk of metal dusting, a recycle gas duct 11 is arranged within the fuel supply tube, between the inner wall of the fuel supply tube and the outer wall of the oxidizer supply tube. Hence, the inner recycle gas tube 14 with the inner recycle gas nozzle tip 12 faces the outer wall of the oxidizer supply tube; and the outer recycle gas tube 15, with the outer recycle gas nozzle tip 13, faces the inner wall of the fuel supply tube.

What is claimed is:

1. Burner for a catalytic reactor comprising:

a central oxidizer supply tube for providing oxidant flow to a combustion zone of the reactor with a stationary swirler element, having an internal portion and an external portion, an oxidant inlet and an oxidant nozzle tip;

an outer concentric fuel supply tube for providing fuel flow to the combustion zone with an inner side, an outer side, a fuel inlet and a fuel nozzle tip concentric with and proximate the oxidant nozzle tip; and a recycle gas duct arranged within the fuel supply tube, the recycle gas duct being further arranged within a space between the central oxidizer supply tube and the outer concentric fuel supply tube, and wherein said recycle gas duct has an inlet and a recycle gas nozzle tip the recycle gas nozzle tip comprising an inner recycle gas nozzle tip and an outer recycle gas nozzle tip, wherein the inner recycle gas nozzle tip is between the oxidizer supply tube and the outer recycle gas nozzle tip, the recycle gas duct allowing recycle gas to flow in between the central oxidizer supply tube and the outer concentric fuel supply tube, wherein the recycle gas duct is arranged so the inner recycle gas nozzle tip has a distance X from the outer side of the oxidizer supply tube, and the outer recycle gas nozzle tip has a distance Y from the inner side of the fuel supply tube, and where X is large enough to provide fuel flow passage between the outer side of the oxidizer supply tube and the inner recycle gas nozzle tip and Y is large enough to provide fuel flow passage between the inner side of the fuel supply tube and the outer recycle gas nozzle tip, and wherein the oxidant nozzle tip, the fuel nozzle tip, and the recycle gas nozzle tip are curved in direction toward the central axis of the burner such that the fluid ejected from the nozzles is directed toward the central axis of the burner, and wherein said recycle gas duct is an annular duct comprising two concentric recycle gas tubes, an inner recycle gas tube with the inner recycle gas nozzle tip and an outer recycle gas tube with the outer recycle gas nozzle tip, and wherein the recycle pas nozzle tip is upstream of the oxidant nozzle tip and the fuel nozzle tip, and the oxidant nozzle tip is upstream of the fuel nozzle tip.

2. Burner according to claim 1, wherein the distance from the outer side of the oxidizer supply tube and the lower part of the inner recycle gas tube is at least X and the distance from the inner side of the fuel supply tube and the lower part of the outer recycle gas tube is at least Y.

3. Burner according to claim 1, wherein X is at least 1 mm and Y is at least 1 mm.

4. Burner according to claim 1, wherein the recycle gas nozzle tips are arranged in a distance L up-stream with relation to the fuel flow direction from the oxidant nozzle tip and the fuel nozzle tip.

5. Burner according to claim 4, wherein the distance between the inner recycle gas nozzle tip and the outer recycle gas nozzle tip is Z, and the distance L is in the following range: $0<L<(X+Y+Z)\times 20$.

6. Burner according to claim 4, wherein the distance L is large enough to ensure partial mixing of the recycle gas and the fuel.

7. Burner according to claim 4, wherein the distance L is large enough to achieve more than 90% mixture of the recycle gas with the fuel before the fuel and the recycle gas passes the fuel nozzle tip and reaches a combustion zone of the catalytic reactor.

8. Burner according to claim 1, wherein the fuel is a gaseous hydrocarbon and the recycle gas is a recycle gas from a Fisher Tropsh synthesis.

9. A method for burning a fuel in a catalytic reactor comprising the steps of:

providing a first stream comprising oxidant to an oxidant inlet of a central oxidizer supply tube comprising an inner and an outer side;

providing a second stream comprising fuel to a fuel inlet of an outer fuel supply tube concentric to the oxidizer supply tube and comprising an inner and an outer side;

providing a third stream comprising recycle gas to a recycle gas inlet of a recycle gas duct arranged within the fuel supply tube;

flowing the first stream from the oxidant inlet, through the central oxidizer supply tube to an oxidant nozzle tip, inducing a swirl to the first stream by means of a stationary swirler element mounted in the central oxidizer supply tube and exiting the first stream from the oxidizer supply tube via the oxidant nozzle tip opening;

flowing the second stream from the fuel inlet, through the outer fuel supply tube and exiting the second stream from the outer fuel supply tube via a fuel outlet between the oxidant nozzle tip and a fuel nozzle tip of the outer fuel supply tube; and flowing the third stream from the recycle gas inlet, through the recycle gas duct and exiting the third stream within the flow of the second stream at a recycle gas nozzle tip within the fuel nozzle tip and outside the oxidant nozzle tip, wherein the recycle gas nozzle tip comprising an inner recycle gas nozzle tip and an outer recycle gas nozzle tip, wherein the inner recycle gas nozzle tip is between the oxidizer supply tube and the outer recycle gas nozzle tip, wherein the recycle gas nozzle tip is upstream of the oxidant nozzle tip and the fuel nozzle tip, and the oxidant nozzle tip is upstream of the fuel nozzle tip, and wherein the oxidant nozzle tip, the fuel nozzle tip, and the recycle gas nozzle tip are curved such that the first stream, the second stream, and the third stream are ejected from the nozzles in a direction toward the central axis of the burner.

10. A method according to claim 9, wherein the third stream is partially mixed with the second stream before the partially mixed third and second stream flows through the fuel outlet and reaches a combustion zone of the catalytic reactor.

11. A method according to claim 9, wherein the second stream is gaseous hydrocarbon and the third stream is a recycle gas from a Fisher Tropsh synthesis.

12. A method according to claim 9, wherein the temperature of the second stream is within a critical metal dusting temperature range and the temperature of the third stream is outside a critical metal dusting temperature range.

13. A method according to claim 10, wherein the third stream is sufficiently mixed with the second stream to avoid soot formation.

14. Use of a burner according to claim 1 for carrying out catalytic processes in a gas fueled reactor.

* * * * *